US008123319B2

(12) United States Patent
Hoisington et al.

(10) Patent No.: US 8,123,319 B2
(45) Date of Patent: Feb. 28, 2012

(54) HIGH SPEED HIGH RESOLUTION FLUID EJECTION

(75) Inventors: Paul A. Hoisington, Hanover, NH (US); Steven H. Barss, Wilmot Flat, NH (US)

(73) Assignee: FUJIFILM Corporation (JP)

( * ) Notice: Subject to any disclaimer, the term of this patent is extended or adjusted under 35 U.S.C. 154(b) by 211 days.

(21) Appl. No.: 12/500,560

(22) Filed: Jul. 9, 2009

(65) Prior Publication Data

US 2011/0007107 A1 Jan. 13, 2011

(51) Int. Cl.
*B41J 29/38* (2006.01)
*B41J 2/135* (2006.01)

(52) U.S. Cl. ..... 347/12; 347/5; 347/9; 347/20; 347/37; 347/40; 347/44

(58) Field of Classification Search ..... 347/9, 12, 347/40, 41
See application file for complete search history.

(56) References Cited

U.S. PATENT DOCUMENTS

| | | | | |
|---|---|---|---|---|
| 4,963,882 | A | 10/1990 | Hickman | |
| 5,265,315 | A | 11/1993 | Hoisington et al. | |
| 5,430,469 | A | 7/1995 | Shioya et al. | |
| 5,650,803 | A | 7/1997 | Tamura et al. | |
| 5,883,644 | A * | 3/1999 | Nicoloff et al. | 347/12 |
| 5,943,072 | A * | 8/1999 | Robert et al. | 347/40 |
| 5,984,455 | A * | 11/1999 | Anderson | 347/47 |
| 6,067,405 | A * | 5/2000 | Serra | 358/1.8 |
| 6,089,692 | A | 7/2000 | Anagnostopoulos | |
| 6,164,745 | A * | 12/2000 | Nagoshi et al. | 347/15 |
| 6,189,993 | B1 | 2/2001 | Mantell | |
| 6,260,939 | B1 | 7/2001 | Shioya et al. | |
| 6,264,298 | B1 | 7/2001 | Mantell | |
| 6,478,397 | B2 | 11/2002 | Chang et al. | |
| 6,481,820 | B1 | 11/2002 | Tamura et al. | |
| 6,513,906 | B1 | 2/2003 | Tanaka et al. | |
| 6,575,558 | B1 * | 6/2003 | Grose et al. | 347/40 |
| 6,776,468 | B2 * | 8/2004 | Miller et al. | 347/9 |
| 6,779,861 | B2 * | 8/2004 | Mori | 347/12 |

(Continued)

FOREIGN PATENT DOCUMENTS

| | | |
|---|---|---|
| EP | 0 914 950 | 5/1999 |

(Continued)

OTHER PUBLICATIONS

International Search Report and Written Opinion dated Sep. 30, 2009 for International Application No. PCT/US2009/043279, 10 pages.

(Continued)

*Primary Examiner* — Ryan Lepisto
(74) *Attorney, Agent, or Firm* — Fish & Richardson P.C.

(57) ABSTRACT

The first plurality of nozzles and the second plurality of nozzles in a fluid ejection system are arranged in a plurality of nozzle pairs, each nozzle pair of the plurality of nozzle pairs including a first nozzle from the first plurality of nozzles and an associated second nozzle from the second plurality of nozzles, the first nozzle and associated second nozzle of each nozzle pair spaced apart in a second direction perpendicular to a first direction, the first direction being the direction of movement of a print media, by greater than zero and less than the pixel pitch p and spaced apart in the first direction. A controller is configured to cause the first nozzle and the second nozzle of each nozzle pair to deposit droplets at the same pixel in a line of pixels.

24 Claims, 7 Drawing Sheets

U.S. PATENT DOCUMENTS

| | | | | |
|---|---|---|---|---|
| 6,837,574 | B2 | 1/2005 | Yamada et al. | |
| 7,281,778 | B2 | 10/2007 | Hasenbein et al. | |
| 2005/0088483 | A1 | 4/2005 | Powers et al. | |
| 2005/0270329 | A1* | 12/2005 | Hoisington et al. | 347/42 |
| 2006/0007257 | A1* | 1/2006 | Chiwata | 347/15 |
| 2006/0012631 | A1* | 1/2006 | Niekawa | 347/41 |
| 2006/0170730 | A1* | 8/2006 | Rogers | 347/40 |
| 2006/0203022 | A1* | 9/2006 | Mizuno | 347/15 |
| 2007/0120883 | A1 | 5/2007 | Tsuboi | |
| 2008/0170088 | A1 | 7/2008 | Letendre et al. | |
| 2009/0289986 | A1 | 11/2009 | Laaspere et al. | |
| 2011/0187773 | A1 | 8/2011 | Kusakari et al. | |

FOREIGN PATENT DOCUMENTS

| | | |
|---|---|---|
| JP | 2002144542 | 5/2002 |
| JP | 2004009549 | 1/2004 |
| JP | 2004148689 | 5/2004 |
| JP | 2005199692 | 7/2005 |
| WO | 2009142894 | 11/2009 |

OTHER PUBLICATIONS

International Preliminary Report on Patentability dated Dec. 2, 2010 issued for International Application No. PCT/US2009/043279, 5 pages.

* cited by examiner

HIGH SPEED HIGH RESOLUTION FLUID EJECTION

TECHNICAL FIELD

The present disclosure relates generally to fluid droplet ejection.

BACKGROUND

In some implementations of a fluid droplet ejection device, a substrate, such as a silicon substrate, includes a fluid pumping chamber and a nozzle formed therein. Fluid droplets can be ejected from the nozzle onto a medium, such as in a printing operation. The nozzle is fluidly connected to the fluid pumping chamber. The fluid pumping chamber can be actuated by a transducer, such as a thermal or piezoelectric actuator, and when actuated, the fluid pumping chamber can cause ejection of a fluid droplet through the nozzle. The medium can be moved relative to the fluid ejection device. The ejection of a fluid droplet from a nozzle can be timed with the movement of the medium to place a fluid droplet at a desired location on the medium. Fluid ejection devices typically include multiple nozzles, and it is usually desirable to eject fluid droplets of uniform size and speed, and in the same direction, to provide uniform deposition of fluid droplets on the medium.

SUMMARY

In general, in one aspect, a fluid ejection system includes a fluid reservoir, a support to move a media in a first direction, a first plurality of independently controllable fluid ejector units, a second plurality of independently controllable fluid ejector units, and a controller electronically coupled to the first plurality of actuators and the second plurality of actuators. The first plurality of independently controllable fluid ejector units includes a first plurality of nozzles and a first plurality of actuators and is coupled to draw a liquid from the fluid reservoir. The second plurality of independently controllable fluid ejector units includes a second plurality of nozzles and a second plurality of actuators and is coupled to draw the same liquid from the fluid reservoir. The controller is configured to cause the first plurality of nozzles and the second plurality of nozzles to eject droplets of the liquid while the media is moving to form a line of pixels on the media in a single pass, pixels in the line of pixels uniformly spaced at a pixel pitch p. The first plurality of nozzles and the second plurality of nozzles are arranged in a plurality of nozzle pairs, each nozzle pair of the plurality of nozzle pairs including a first nozzle from the first plurality of nozzles and an associated second nozzle from the second plurality of nozzles, the first nozzle and associated second nozzle of each nozzle pair spaced apart in a second direction perpendicular to the first direction by greater than zero and less than the pixel pitch p and spaced apart in the first direction, and wherein the controller is configured such that the first nozzle and the second nozzle of each nozzle pair deposit droplets at the same pixel in the line of pixels.

In general, in one aspect, a fluid ejection system includes a fluid reservoir, a support to move a media in a first direction, a first plurality of independently controllable fluid ejector units, a second plurality of independently controllable fluid ejector units, and a controller electronically coupled to the first plurality of actuators and the second plurality of actuators. The first plurality of independently controllable fluid ejector units includes a first plurality of nozzles and a first plurality of actuators and is coupled to draw a liquid from the fluid reservoir. The second plurality of independently controllable fluid ejector units includes a second plurality of nozzles and a second plurality of actuators and is coupled to draw the same liquid from the fluid reservoir. The controller is configured to cause the first plurality of nozzles and the second plurality of nozzles to eject droplets of the liquid while the media is moving to form a line of pixels on the media in a single pass at a speed of greater than 3 m/s, pixels in the line of pixels uniformly spaced at a pixel pitch p. The first plurality of nozzles and the second plurality of nozzles are arranged in a plurality of nozzle pairs, each nozzle pair of the plurality of nozzle pairs including a first nozzle from the first plurality of nozzles and an associated second nozzle from the second plurality of nozzles, the first nozzle and associated second nozzle of each nozzle pair spaced apart in a second direction perpendicular to the first direction by less than the pixel pitch p and spaced apart in the first direction, and wherein the controller is configured such that the first nozzle and the second nozzle of each nozzle pair deposit droplets at the same pixel in the line of pixels.

These and other embodiments can optionally include one or more of the following features. The first plurality of nozzles and the second plurality of nozzles can have n rows of nozzles per pixel in the second direction, and a spacing between the nozzles in the second direction can be greater than zero and less than p/n.

The first plurality of independently controllable fluid ejector units and the second plurality of independently controllable fluid ejector units can be part of the same fluid ejection module. The first and second plurality of nozzles can be arranged in a matrix. The first plurality of independently controllable fluid ejector units can be part of a first fluid ejection module, and the second plurality of independently controllable fluid ejector units is part of a second fluid ejection module. The nozzles of the first plurality of nozzles can be arranged in a first matrix, and the nozzles of the second plurality of nozzles can be arranged in a second matrix.

Subpixel droplets can be ejected from the first and second plurality of nozzles. Each plurality of nozzles can eject only one droplet of fluid at each pixel. The first and second plurality of nozzles can be configured such that a line of pixels having a density of greater than 300 dpi is formed when the first and the second nozzle of each nozzle pair deposit droplets at the same pixel in the line of pixels. The density can be approximately 1200 dpi. The first and second plurality of nozzles can be configured to eject liquid having a droplet size of between about 0.1 pL and 30 pL. The line of pixels is formed on the media at a speed greater than 3 m/s. The speed can be approximately 4 m/s.

Certain implementations may have one or more of the following advantages. Having pairs of nozzles spaced apart in a direction perpendicular to the print direction by less than the pixel pitch and spaced apart in the print direction, but controlled to deposit fluid droplets at the same pixel, can increase the print speed, improve print quality, and allow for a decreased fluid ejection module size.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

During fluid droplet ejection, such as digital ink jet printing, it is desirable to print at speeds of 3-5 m/s while avoiding banding and other errors in the printed images. By aligning nozzles such that multiple nozzles drop fluid at each pixel, high quality images at high printing speeds can be achieved.

Figure 1:
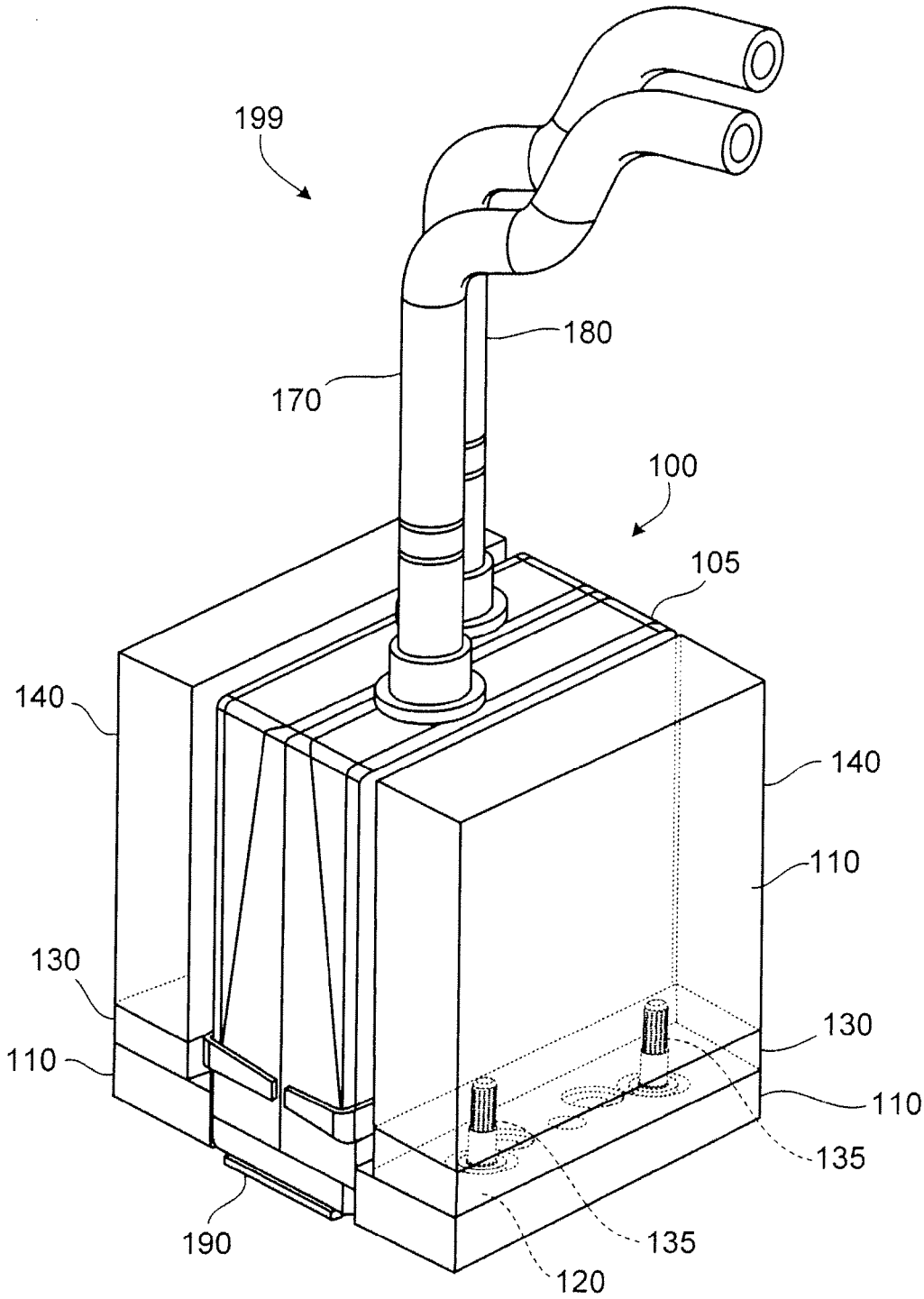
FIG. 1 shows an exemplary fluid ejection module.

Referring to FIG. 1, a fluid ejection system 199 includes a fluid ejector 100 surrounded by a fluid ejector casing 105. A mounting component 110 is attached to the casing 105 to secure the fluid ejector 100 to a print frame 140 to hold the fluid ejector over the print medium. The fluid ejector 100 further includes tubing 170, 180 to carry fluid from a fluid reservoir (not shown).

The fluid ejector 100 also includes a fluid ejection module, e.g., a parallelogram-shaped printhead module, which can be a die fabricated using semiconductor processing techniques, attached to the bottom of the casing 105. The fluid ejection module includes a substrate 190, which can be made of a semiconductor material, e.g. single crystal silicon, with a plurality of fluid flow paths 192 (see FIG. 2B), and a plurality of actuators 401 (see FIG. 2B) to individually control ejection of fluid from nozzles 180 of the fluid flow paths.

The fluid ejector 100 is attached to print frame 140 through a mounting component 110 having a mounting surface 120. A connector 130 is positioned on the mounting surface 120, between the fluid ejector 100 and the print frame 140 and can be detachably connected to the print frame 140, for example with screws 135, so as to allow relatively easy removal without causing damage to the print frame 140.

Figure 2A:
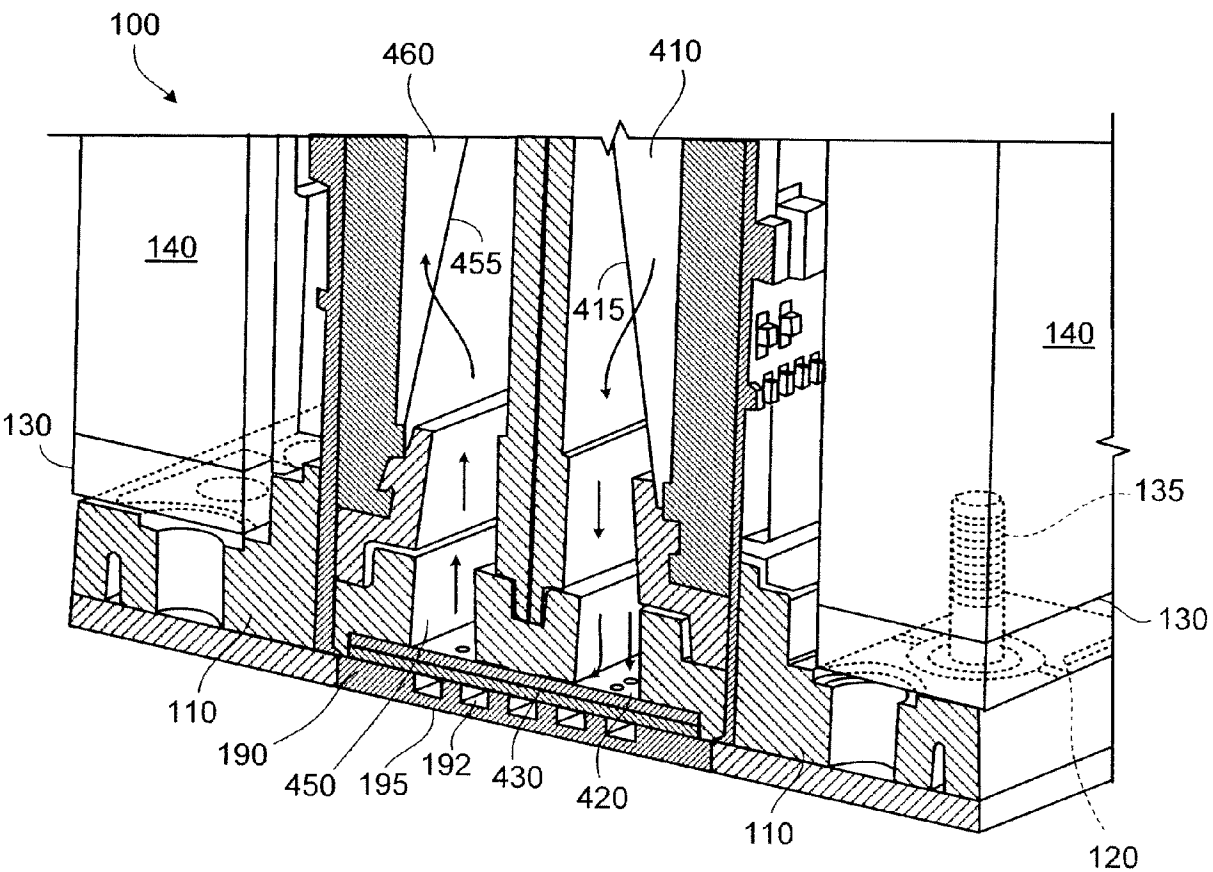
FIG. 2A shows a cross section of an exemplary fluid ejection module.
Figure 2B:
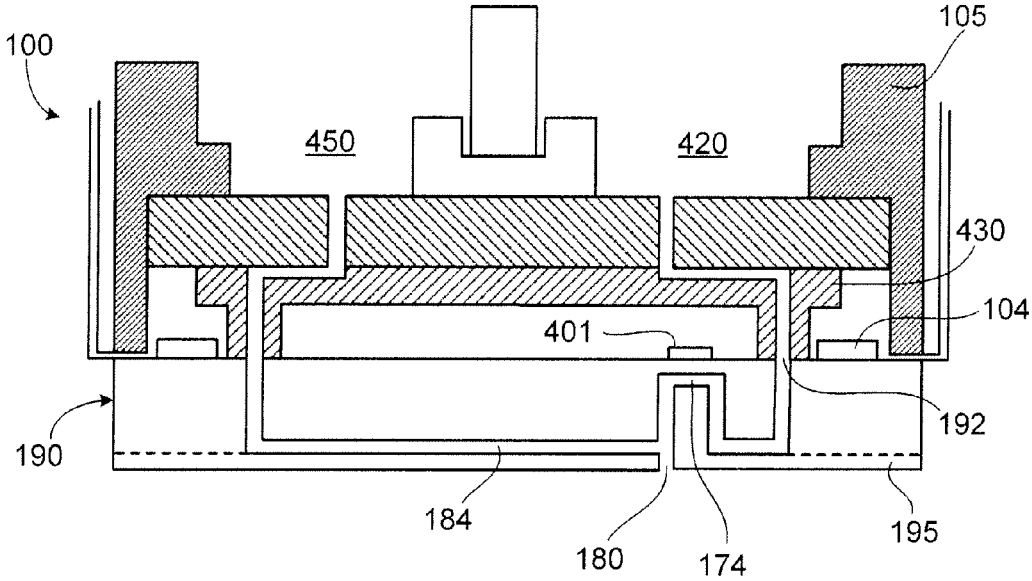
FIG. 2B is a schematic cross sectional view of an exemplary fluid ejection module.

Referring to FIGS. 2A and 2B, the fluid ejector 100 can include an upper supply chamber 410, a supply filter 415, and a lower supply chamber 420. Fluid for ejection can leave the fluid reservoir, enter the upper supply chamber 410, pass through the supply filter 415 into the lower supply chamber 420, through an interposer 430, and into the substrate 190.

The substrate 190 can include a fluid flow path 192 or multiple fluid flow paths 192 and one or more nozzles 180 formed in a nozzle layer 195 (only one fluid flow path 192 and associated nozzle 180 is shown in FIG. 2B). When actuators 401 on the substrate 190 are actuated, pumping chambers 174 in the fluid flow paths 192 can contract, forcing fluid to be ejected as droplets from the nozzles 180. Integrated circuit elements 104 on the substrate 190 provide electrical signals for control of ejection of fluid from the nozzles 180.

The fluid ejector 100 can further include a lower return chamber 450, a return filter 455, and an upper return chamber 460. Fluid that is not ejected through the nozzles 180 can exit the substrate 190 through return passages 184, pass through the interposer 430 into the lower return chamber 450, pass through the return filter 455 into the upper return chamber 460, and return to the fluid reservoir.

Figure 3:
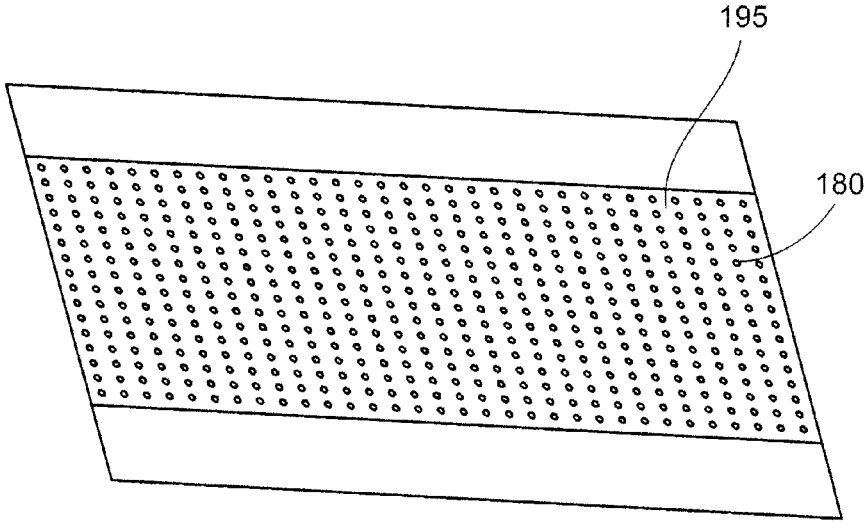
FIG. 3 is a schematic bottom view of a nozzle layer of a fluid ejection module.

As shown in FIG. 3, the nozzle layer 195 on the bottom surface of the substrate 190 includes multiple nozzles 180. The nozzles 180 can be considered part of the fluid paths 192 and can extend through the nozzle layer 195, terminating in an opening in a bottom surface of the nozzle layer 195. The nozzle layer 195 can be a layer that is secured to the substrate 190. Alternatively, the nozzle layer 195 can be a unitary part of the substrate 190, e.g., a result of etching of the flow path body. The nozzles 180 can be in a regular array, e.g., nozzle layer 195 can include multiple columns and row of nozzles 180, although in some implementations the printhead module might include only a single row of nozzles. When the fluid ejector 100 is secured to the print frame 140, the rows of nozzles can be perpendicular or nearly perpendicular to the direction of travel of the print media.

Figure 4:
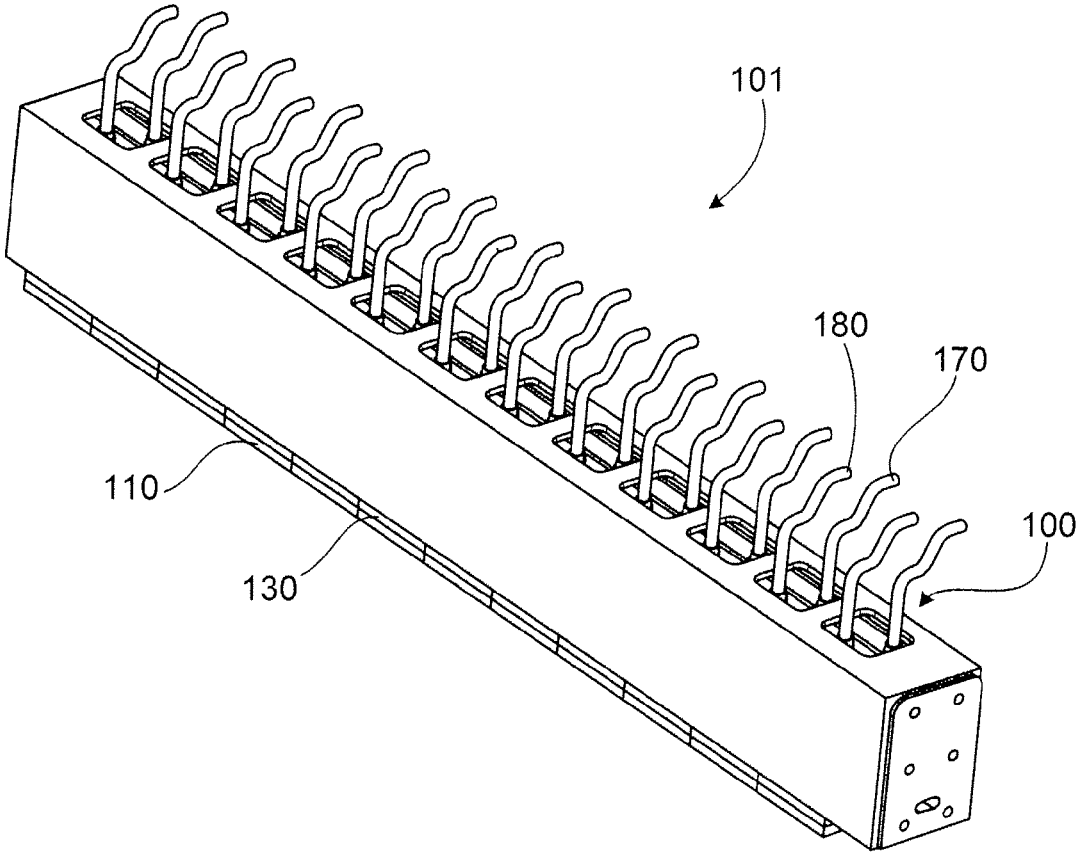
FIG. 4 shows an exemplary fluid ejection system having multiple fluid ejection modules.

In some implementations, as shown in FIG. 4, a fluid ejection system 101 can multiple fluid ejectors 100 mounted to the print frame 140, e.g., side-by-side (perpendicular to the direction of travel of the print media) to extend across the width of the print media. Each fluid ejector 100 includes a mounting component 110. Connectors 130 are positioned between each mounting component 110 and the print frame 140, which as shown includes an optional upper portion 141. The tubing 170 supply fluid to each fluid ejector 100, and the tubing 180 provide a fluid return path for each fluid ejector 100. Each fluid ejector 100 on a common print frame 140 can be connected through tubing 170 and 180 to a common fluid reservoir, i.e., each fluid ejector 100 (and the nozzles thereof) can eject the same fluid, e.g. color of ink. In addition, fluid ejector 100 on different print frames 140 in the same printer can be connected through tubing 170 and 180 to a common fluid reservoir, i.e., fluid ejectors 100 (and nozzles thereof) located at different positions along the direction of travel of the print media can eject the same fluid, e.g. color of ink.

Figure 5:
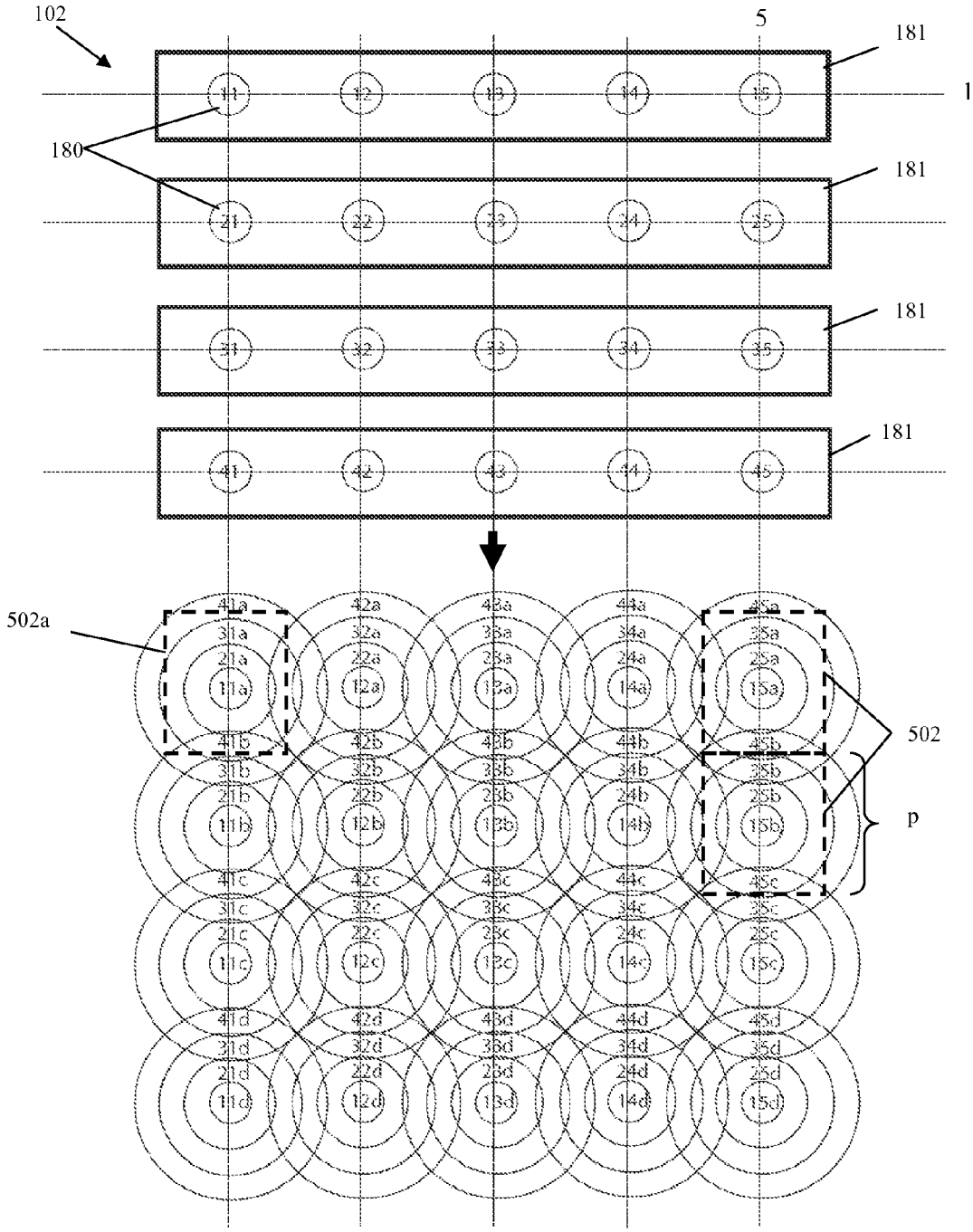
FIG. 5 illustrates a relationship of a fluid ejection system having multiple aligned nozzles per pixel to locations of droplets deposited on the print media.
Figure 6:
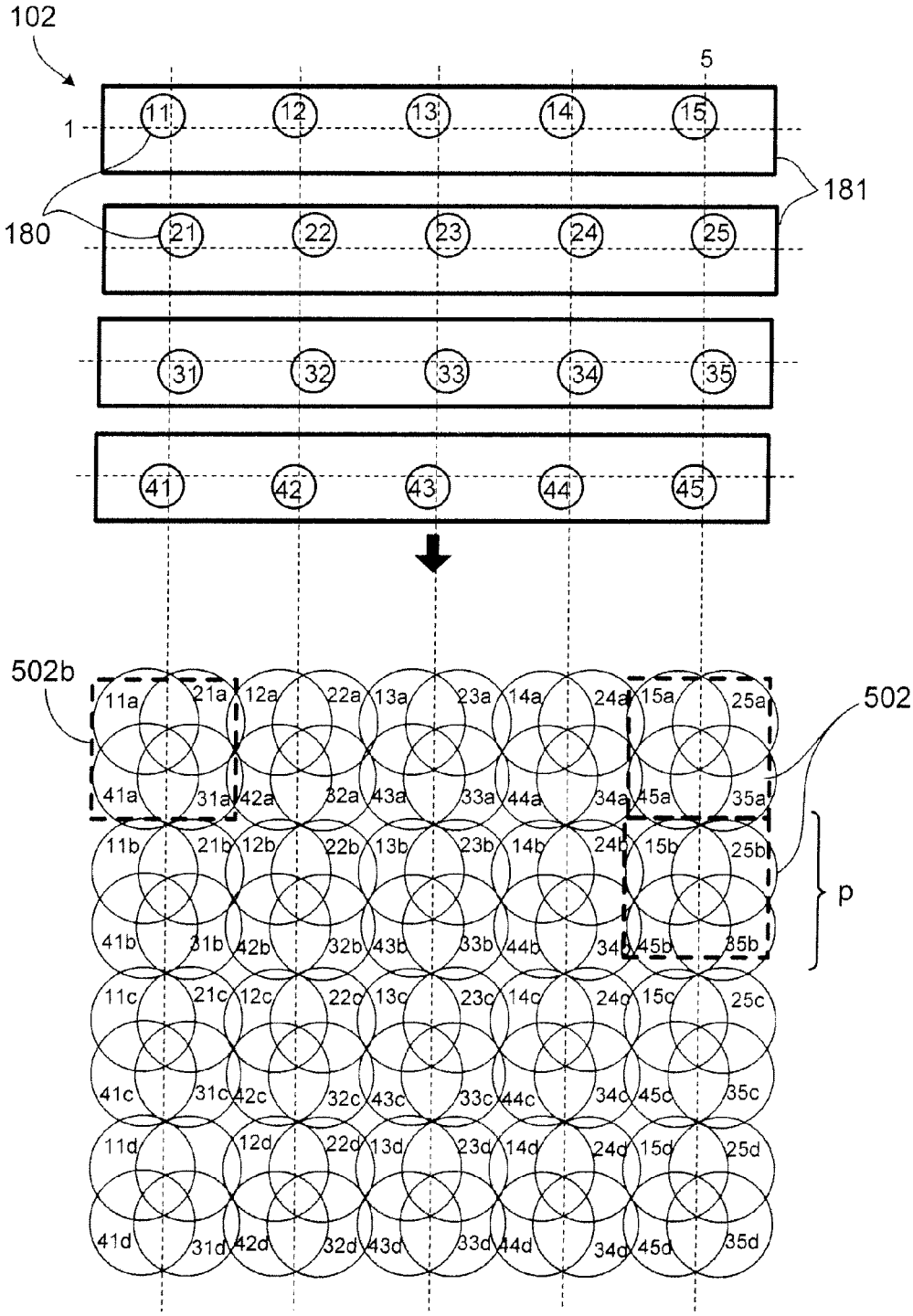
FIG. 6 illustrates a relationship of a fluid ejection system having multiple offset nozzles per pixel to locations of droplets deposited on the print media.

Referring to FIGS. 5 and 6, a fluid ejection system 102 can include a multiple sets 181 of nozzles 180. The nozzles 180 of each of the sets 181 can be spaced apart from one another in the print direction (the direction of travel of the print media, shown by the arrow in FIG. 5). Although spaced apart, the nozzles can be in proximity in the print direction, e.g. approximately 100-1,000 μm apart if in the same module and approximately 10 mm apart if in separate modules, to minimize issues with web weave, as discussed further below. The nozzles of a particular set can be controlled to fire droplets to form a line of adjacent pixels on the print media perpendicular to the print direction. The nozzles of a particular set are all formed in the same fluid ejection module. The different sets 181 of nozzles 180 may all be part of the same fluid ejection module, or at least some of the sets may be part of separate fluid ejection modules, e.g., every set of nozzles can be formed on a different fluid ejection module.

Figure 7:
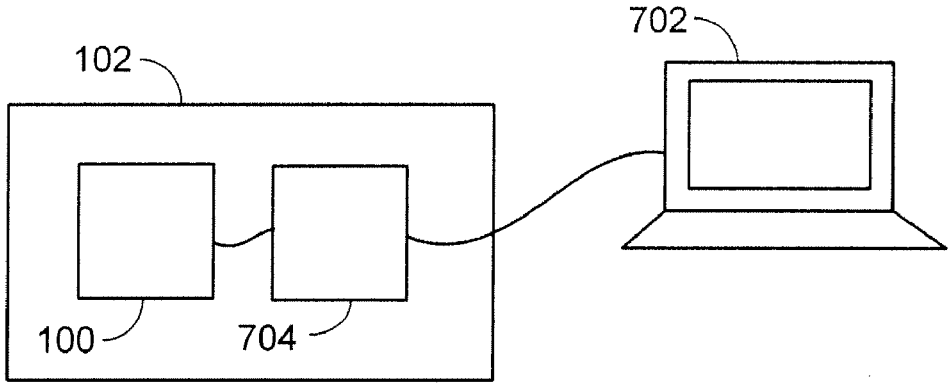
FIG. 7 is a schematic illustration of a printing system.

As shown in FIG. 7, a controller 702 can be electronically coupled to the fluid ejector 100 through a circuit board 704. The circuit board 704 can be electronically connected with the integrated circuit elements 104 of the substrate 190 to control ejection of fluid from the fluid ejector 100 The controller 702 can cause the nozzles 180 of the sets 181 of nozzles to eject droplets of liquid while a media is moving to form a line of pixels 502 on the media in a single pass, for example along axis 5 in FIGS. 5 and 6. For example, the controller 702 can send image data to the fluid ejector 100 in queues, each queue representing the desired printing order for a set of nozzles. The pixels can be uniformly spaced at a pixel pitch p, for example of between 20 and 250 μm. Although only three pixels 502 are outlined in dotted lines in FIGS. 5 and 6, each build-up of fluid droplets shown has a corresponding pixel.

Referring to FIG. 5, for each set, the nozzles 180 of the set 181 can be aligned on an axis perpendicular or nearly perpendicular to the print direction. For example, the set of nozzles including nozzles 11, 12, 13, 14, and 15 is aligned along axis 1 in the direction perpendicular or nearly perpendicular to the print direction. Although the nozzles of each set are shown in FIG. 5 as aligned, the sets 181 of nozzles 180 need not be aligned in the direction perpendicular to the print direction. Rather, the nozzles in the set can be offset along the print direction, but by application of appropriate delays by the controller 702, the set of nozzles can be caused to eject droplets to form a line of adjacent pixels on the print media along a line perpendicular to the print direction. For example, the controller might put print data in a queue, each queue including a delay such that two sets of nozzles not aligned in the direction perpendicular to the print direction still print a line of pixels perpendicular to the print direction.

In addition, nozzles from multiple sets can form groups, with each group having one nozzle from each set, and with the nozzles 180 of each of the groups aligned along an axis parallel to the print direction. For example, in FIG. 5, the group of nozzles including nozzles 15, 25, 35, and 45 are aligned along axis 5 in the print direction.

During fluid droplet ejection, the controller can cause the nozzles 180 of each group to deposit droplets at the same pixel 502. The droplets of fluid can be 0.1 pL-30 pL in size, such as 0.1 pL-2.0 pL, and can be subpixel droplets, i.e. smaller than would be required to fully fill the pixel 502 if additional droplets were not added by other nozzles. For example, as shown in FIG. 5, nozzle 11 might eject a droplet 11*a* of fluid at pixel location 502*a*. Nozzle 21 might then eject a droplet of fluid directly over droplet 11*a* at the same pixel location 502*a*, causing the accumulated fluid on the print media at pixel location 502*a* to spread over region 21*a*. Nozzle 31 might also eject a droplet of fluid at pixel location 502*a*, causing the accumulated fluid on the print media at pixel location 502*a* to spread over region 31*a*, and so on. The result would be a pixel 502*a* fully covered in fluid from the various droplets. The same process would occur for every pixel 502 along the media. Although not shown, an additional set of nozzles could be included for redundancy.

A fluid ejection system can thus include first and second sets of nozzles at least partially overlapping in a direction perpendicular to the direction of travel of the print media so that some of the nozzles in the first set align with some of the nozzles in the second set to form one or more pairs of aligned nozzles. The fluid ejection system can further include a mechanism to enable, in at least one pair of the aligned nozzle, one nozzle to eject a first ink drop that has a size smaller than a size of an ink drop the nozzle would otherwise be required to eject to form a desired pixel on the substrate and the other nozzle to eject a second ink drop that has a size sufficient to form the desired pixel in combinations with the first ink drop. Each nozzle in the first set can align with a corresponding nozzle in the second set.

Referring to FIG. 6, in other implementations, the nozzles can be misaligned, i.e. not perfectly aligned along an axis. Thus, the nozzles 180 of each set 181 can be offset from one another in a direction perpendicular to the print direction. For example, in FIG. 6, the set of nozzles including nozzles 11, 12, 13, 14, and 15 are each offset from axis 1. Again, although shown in FIG. 6 as approximately aligned, the 181 sets of nozzles 180 need not be aligned, as the ejection of fluid droplets along a line perpendicular to the print direction can be caused by delays set by the controller 702.

Nozzles from multiple sets can form groups, with each group having one nozzles from each set, and with the nozzles 180 of each of the groups approximately aligned along an axis parallel to the print direction. The nozzles 180 of each group can be offset from one another in the direction parallel to the print direction. For example, in FIG. 6, the group of nozzles including nozzles 15, 25, 35, and 45 are each offset from axis 5. Any pair of nozzles from the same group of nozzles, but different sets of nozzles, can be offset by a same amount. Further, the offset for nozzles in a particular group can form a repetitive pattern.

As in the embodiment of FIG. 5, during fluid droplet ejection, the controller can cause the nozzles 180 of each of the sets 181 that are approximately aligned along the direction parallel to the print direction to deposit droplets at the same pixel 502. Again, the droplets of fluid can be subpixel droplets, i.e. smaller than would usually be required to fill the pixel 502. Unlike the embodiment of FIG. 5, however, the droplets of fluid ejected from nozzles approximately aligned along the print direction are not concentric within a pixel 502. Rather, the droplets each land in a slightly different spot within a pixel 502. For example, as shown in FIG. 6, nozzle 11 might eject a droplet 11*a* of fluid at in the upper left-hand corner of pixel location 502*b*. Nozzle 21 might then eject a droplet of fluid 21*a* in the upper right hand corner of pixel location 502*b*. Although droplets 11*a* and 21*a* overlap, they are not concentric with one another. Likewise, nozzle 31 might eject a droplet of fluid 31*a* in the lower right hand corner, and nozzle 41 might eject a droplet of fluid 41*a* in the lower left hand corner. The result would be a pixel 502*b* fully covered in fluid from the various drops. The same process would occur for every pixel 502 along the media. Although not shown, an additional set of nozzles could be included for redundancy.

There can be n columns of nozzles per pixel, the columns parallel to the print direction, and nozzles within a set can be separated with a uniform pitch p. For example, in FIG. 6, there are two columns of nozzles per pixel; for pixel 502*b*, nozzles 11 and 41 form one column, and nozzles 21 and 31 the other column. The spacing between nozzles that are approximately aligned in the print direction, i.e., in different sets but in the same group, e.g. along axis 5 in the embodiment of FIG. 6, can be greater than zero, e.g., greater than $k*p/(n-1)$ where k is about 0.1-1.0, for example 0.5, but less than p/n in the direction perpendicular to the print direction. Thus, in FIG. 6, the distance between nozzles 11 and 21 in the direction perpendicular to the print direction is greater than zero, but less than p/2. Although the nozzles 180 of FIG. 6 are shown as arranged in a regular pattern, a more stochastic pattern could be used. Further, the nozzles 180 in each group can be arranged in a matrix having interlacing. An exemplary interlacing arrangement is described in U.S. application No. 61/055,936, titled NOZZLE LAYOUT FOR FLUID DROPLET EJECTING, all of which is incorporated herein by reference.

Although four sets 181 of nozzles 180 are shown in FIGS. 5 and 6, the fluid ejection system 102 can include fewer or greater numbers of sets. For example, there may only be two sets 181 of nozzles 180. As such, only two nozzles, i.e. one pair of nozzles, would eject fluid at each pixel 502. Further, although the sets 181 of nozzles 180 are shown in FIGS. 5 and 6 as including only a single row nozzles along the direction perpendicular to the print direction, the nozzles 180 of each set 181 may be arranged in a matrix.

An alignment mechanism can be used to obtain the desired relative position for nozzles that are in different fluid, i.e. to adjust those nozzles spaced apart in the print direction or perpendicular to the print direction.

By having multiple nozzles per scan line, i.e. multiple droplets of fluid ejected at each pixel, higher speed, e.g. 3-5 m/s or higher, fluid droplet ejection can be achieved than in conventional single pass printing because smaller droplets can be ejected at a higher frequency. For example, a conventional interleaved single pass fluid ejection system might include a single nozzle to eject a droplet of 2 pL at each pixel at 1200 dpi at an operating frequency of 100 kHZ for a maximum printing speed of 2.1 m/s. The system described herein, however, could include four nozzles ejecting 0.5 pL droplets of fluid at a single pixel at 1200 dpi and an operating frequency of 200 kHZ for a maximum printing speed of 4.2 m/s. Although the example described herein suggests a dpi of 1200, the system could be used for a dpi anywhere from 300 to 2400. Further, speeds higher than 3-5 m/s are possible by reducing the droplet size to get higher operating frequencies and utilizing more jets per scan line.

In conventional single pass printing, where a single jet fires continuously to produce a line of ink on the page, errors can occur in the resulting image, such as banding and edge raggedness, due to misalignment of the jets, nozzle straightness errors, jet velocity, and web weave errors. Further, in a system using an interleaved approach to obtain higher speeds, i.e. a system in which two sets of nozzles are aligned in the print direction, and each row prints every other line of pixels, banding can occur in the process direction due to misalignment of the first set of nozzles in relation to the second set of nozzles.

Advantageously, with a fluid ejection system as described herein, wherein multiple nozzles drop fluid at the same pixel location, the print quality can be increased. Because each nozzle ejects fluid at each pixel, banding will not occur in the processing direction. Further, in the system described herein, print quality can be increased by electronically adjusting drops a pixel at a time in the process direction simply by adjusting the firing pulse used. For example, in a 1200 dpi printer, the drops can be electrically adjusted in about 20 micron increments to compensate for fixed errors such as stand off and jet velocity offset. Moreover, printing quality can be improved if all of the jets that address a particular line of pixels can be located in a single print-head close together to improve mechanical alignment and minimize jet-to-jet velocity variations. Finally, by using the fluid ejection system described herein, the drop size can be modulated 4:1 at each location, thereby allowing for an improved grayscale system wherein between 0 and 4 drops could be ejected at each pixel.

Misaligning the nozzles such that each nozzle drops fluid at a separate location within a single pixel can further improve the quality of the resulting image. During conventional fluid droplet ejection, the surface energy of the droplets can cause the drops to fail spread out over the entire pixel area. By offsetting multiple droplets at the same pixel, the ink can spread out better throughout the pixel, resulting in a larger spot than if the drops all landed on top of one another. For example, in the 1200 dpi example given above, the drops would be spread out 10-20 microns. The result is improved dot gain linearity and a reduced amount of ink needed for solid coverage.

Moreover, redundancy can be provided more efficiently, as adding one additional jet to a four-jet line, for example, would increase the jet count by only 25%. As long as no more than one jet is out in each group, normal output could be reached. Further, even if two jets were out in one group, acceptable printing could still be produced if all five jets were working in one or both of the neighboring lines.

The controller can cause each nozzle in a group to eject the same volume of fluid. Even when less than all of the a pixel is desired to be covered, e.g., for printing of a grayscale pixel, the volume of fluid ejected by each nozzle of the group can be reduced (compared to a pixel at full intensity) with each nozzle in the group ejecting a droplet of the same volume.

Finally, although the system described herein requires additional circuitry and data throughput, the fluid ejection system can advantageously be made smaller than an interleaved fluid ejection system. For example, four 0.5 pL gets could ideally fit in the same area as one 2.0 pL jet, while the interleaved approach would require two 2.0 pL jets.

Particular embodiments have been described. Other embodiments are within the scope of the following claims.

What is claimed is:

1. A fluid ejection system comprising:

a fluid reservoir;

a support to move a media in a first direction;

a first plurality of independently controllable fluid ejector units comprising a first plurality of nozzles and a first plurality of actuators, the first plurality of independently controllable fluid ejector units coupled to draw a liquid from the fluid reservoir;

a second plurality of independently controllable fluid ejector units comprising a second plurality of nozzles and a second plurality of actuators, the second plurality of independently controllable fluid ejector units coupled to draw a same liquid from the fluid reservoir;

a controller electronically coupled to the first plurality of actuators and the second plurality of actuators and configured to cause the first plurality of nozzles and the second plurality of nozzles to eject droplets of the liquid while the media is moving to form a line of pixels on the media in a single pass, pixels in the line of pixels uniformly spaced at a pixel pitch p;

wherein the first plurality of nozzles and the second plurality of nozzles are arranged in a plurality of nozzle pairs, each nozzle pair of the plurality of nozzle pairs including a first nozzle from the first plurality of nozzles and an associated second nozzle from the second plurality of nozzles, the first nozzle and associated second nozzle of each nozzle pair spaced apart in a second direction perpendicular to the first direction by greater than zero and less than the pixel pitch p and spaced apart in the first direction, and wherein the controller is configured such that the first nozzle and the second nozzle of each nozzle pair deposit droplets at the same pixel in the line of pixels.

2. The fluid ejection system of claim 1, wherein the first plurality of nozzles and the second plurality of nozzles each have n rows of nozzles per pixel in the second direction, and wherein a spacing between the nozzles in the second direction is greater than zero and less than p/n.

3. The fluid ejection system of claim 1, wherein the first plurality of independently controllable fluid ejector units and the second plurality of independently controllable fluid ejector units are part of a same fluid ejection module.

4. The fluid ejection system of claim 3, wherein the first and second plurality of nozzles are arranged in a matrix.

5. The fluid ejection system of claim 1, wherein the first plurality of independently controllable fluid ejector units is part of a first fluid ejection module, and wherein the second plurality of independently controllable fluid ejector units is part of a second fluid ejection module.

6. The fluid ejection system of claim 5, wherein the nozzles of the first plurality of nozzles are arranged in a first matrix, and wherein the nozzles of the second plurality of nozzles are arranged in a second matrix.

7. The fluid ejection system of claim 1, wherein subpixel droplets are ejected from the first and second plurality of nozzles.

8. The fluid ejection system of claim 1, wherein each plurality of nozzles ejects only one droplet of fluid at each pixel.

9. The fluid ejection system of claim 1, wherein the first and second plurality of nozzles are configured such that a line of pixels having a density of greater than 300 dpi is formed when the first and the second nozzle of each nozzle pair deposit droplets at the same pixel in the line of pixels.

10. The fluid ejection system of claim 9, wherein the density is approximately 1200 dpi.

11. The fluid ejection system of claim 1, wherein the first and second plurality of nozzles are configured to eject liquid having a droplet size of between about 0.1 pL and 30 pL.

12. The fluid ejection system of claim 1, wherein the line of pixels is formed on the media at a speed greater than 3 m/s.

13. The fluid ejection system of claim 12, wherein the speed is approximately 4 m/s.

14. A fluid ejection system comprising:

a fluid reservoir;

a support to move a media in a first direction;

a first plurality of independently controllable fluid ejector units comprising a first plurality of nozzles and a first plurality of actuators, the first plurality of independently controllable fluid ejector units coupled to draw a liquid from the fluid reservoir;

a second plurality of independently controllable fluid ejector units comprising a second plurality of nozzles and a second plurality of actuators, the second plurality of independently controllable fluid ejector units coupled to draw a same liquid from the fluid reservoir;

a controller electronically coupled to the first plurality of actuators and the second plurality of actuators and configured to cause the first plurality of nozzles and the second plurality of nozzles to eject droplets of the liquid while the media is moving to form a line of pixels on the media in a single pass at a speed of greater than 3 m/s, pixels in the line of pixels uniformly spaced at a pixel pitch;

wherein the first plurality of nozzles and the second plurality of nozzles are arranged in a plurality of nozzle pairs, each nozzle pair of the plurality of nozzle pairs including a first nozzle from the first plurality of nozzles and an associated second nozzle from the second plurality of nozzles, the first nozzle and associated second nozzle of each nozzle pair spaced apart in a second direction perpendicular to the first direction by less than the pixel pitch p and spaced apart in the first direction, and wherein the controller is configured such that the first nozzle and the second nozzle of each nozzle pair deposit droplets at the same pixel in the line of pixels.

15. The fluid ejection system of claim 14, wherein the first plurality of independently controllable fluid ejector units and the second plurality of independently controllable fluid ejector units are part of a same fluid ejection module.

16. The fluid ejection system of claim 15, wherein the first and second plurality of nozzles are arranged in a matrix.

17. The fluid ejection system of claim 14, wherein the first plurality of independently controllable fluid ejector units is part of a first fluid ejection module, and wherein the second plurality of independently controllable fluid ejector units is part of a second fluid ejection module.

18. The fluid ejection system of claim 17, wherein the nozzles of the first plurality of nozzles are arranged in a first matrix, and wherein the nozzles of the second plurality of nozzles are arranged in a second matrix.

19. The fluid ejection system of claim 18, wherein subpixel droplets are ejected from the first and second plurality of nozzles.

20. The fluid ejection system of claim 14, wherein each plurality of nozzles ejects only one droplet of fluid at each pixel.

21. The fluid ejection system of claim 14, wherein the first and second plurality of nozzles are configured such that a line of pixels having a density of greater than 300 dpi is formed when the first and the second nozzle of each nozzle pair deposit droplets at the same pixel in the line of pixels.

22. The fluid ejection system of claim 21, wherein the density is approximately 1200 dpi.

23. The fluid ejection system of claim 14, wherein the first and second plurality of nozzles are configured to eject liquid having a droplet size of between about 0.1 pL and 30 pL.

24. The fluid ejection system of claim 14, wherein the speed is approximately 4 m/s.

* * * * *